US011069307B2

(12) United States Patent
Cheng et al.

(10) Patent No.: US 11,069,307 B2
(45) Date of Patent: Jul. 20, 2021

(54) SPLICED DISPLAY DEVICE AND BACKLIGHT CONTROL METHOD THEREFOR

(71) Applicants: BEIJING BOE DISPLAY TECHNOLOGY CO., LTD., Beijing (CN); BOE TECHNOLOGY GROUP CO., LTD., Beijing (CN)

(72) Inventors: Jinhui Cheng, Beijing (CN); Hengyu Yan, Beijing (CN); Zhankun Meng, Beijing (CN); Neng He, Beijing (CN); Hanzhang Niu, Beijing (CN)

(73) Assignees: BEIJING BOE DISPLAY TECHNOLOGY CO., LTD., Beijing (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/643,007

(22) PCT Filed: Jun. 27, 2019

(86) PCT No.: PCT/CN2019/093221
§ 371 (c)(1),
(2) Date: Feb. 28, 2020

(87) PCT Pub. No.: WO2020/001525
PCT Pub. Date: Jan. 2, 2020

(65) Prior Publication Data

US 2020/0342819 A1 Oct. 29, 2020

(30) Foreign Application Priority Data

Jun. 27, 2018 (CN) ..... 201810681463.7

(51) Int. Cl.
*G09G 3/34* (2006.01)
*G09G 5/14* (2006.01)

(52) U.S. Cl.
CPC ..... *G09G 3/342* (2013.01); *G09G 5/14* (2013.01); *G09G 2300/026* (2013.01); *G09G 2320/0686* (2013.01)

(58) Field of Classification Search
None
See application file for complete search history.

(56) References Cited

U.S. PATENT DOCUMENTS

2017/0110065 A1* 4/2017 Zhang ..... G09G 3/2018
2018/0075813 A1* 3/2018 Zhang ..... G09G 3/34

FOREIGN PATENT DOCUMENTS

CN 101599258 12/2009
CN 101667389 3/2010
(Continued)

OTHER PUBLICATIONS

Office action from Chinese Application No. 201810681463.7 dated Sep. 25, 2019.
(Continued)

*Primary Examiner* — Krishna P Neupane
(74) *Attorney, Agent, or Firm* — Calfee, Halter & Griswold LLP

(57) ABSTRACT

Disclosed is a spliced display device and a backlight control method therefor. The spliced display device includes a plurality of display modules that include respective backlight modules. Each of the backlight modules includes a plurality of backlight partitions, of which a first backlight partition is located at edge of a corresponding backlight module of the backlight modules. The backlight control method comprises the steps of obtaining an initial brightness value and a reference brightness value for the first backlight partition, adjusting the initial brightness value of the first backlight partition according to the reference brightness value to obtain an adjusted brightness value for the first backlight partition, and controlling the brightness of the first
(Continued)

backlight partition according to the adjusted brightness value.

16 Claims, 4 Drawing Sheets

(56) References Cited

FOREIGN PATENT DOCUMENTS

| | | | | |
|---|---|---|---|---|
| CN | 102270445 | | 12/2011 | |
| CN | 103813116 | | 5/2014 | |
| CN | 106128311 | | 11/2016 | |
| CN | 106409206 | | 2/2017 | |
| CN | 106448576 | * | 2/2017 | ..... G09G 3/34 |
| CN | 106652925 | | 5/2017 | |
| CN | 107331355 | | 11/2017 | |
| CN | 108831386 | | 11/2018 | |
| EP | 1645798 | | 3/2012 | |
| WO | 2018/059115 | | 4/2018 | |

OTHER PUBLICATIONS

Office action from Chinese Application No. 201810681463.7 dated Mar. 2, 2020.

* cited by examiner

SPLICED DISPLAY DEVICE AND BACKLIGHT CONTROL METHOD THEREFOR

RELATED APPLICATIONS

The present application is the U.S. national phase entry of PCT/CN2019/093221, with an international filling date of Jun. 27, 2019, which claims the benefit of Chinese Patent Application No. 201810681463.7, filed on Jun. 27, 2018, the entire disclosures of which are incorporated herein by reference as a part of the present application.

TECHNICAL FIELD

The present invention relates to the field of display technologies, and more particularly to a spliced display device and a backlight control method therefor.

BACKGROUND

Since a spliced display device may be formed by splicing a plurality of display modules, it is possible to realize super-large screens and super-high resolution displays. At present, spliced display devices have been widely used in the fields of conferencing, security, and monitoring.

Each display module of a spliced display device may comprise a display panel and a backlight module. The spliced display panel comprises a plurality of display partitions. The backlight module comprises a backlight partition corresponding to each display partition in a one-to-one relationship. In related art, in order to achieve high dynamic contrast and improve a capability of displaying picture details in a dark state, the backlight module often uses a 3D dynamic local dimming technology to control backlight, that is, to dynamically change brightness of each backlight partition according to brightness information contained in information for a displayed picture. The pixel grey scale statistical brightness of each display partition determines the brightness of the backlight partition corresponding thereto.

Each display module controls brightness of a plurality of backlight partitions of its corresponding backlight module according to a picture to be displayed on a display panel included in it. Therefore, when there is a difference in the pixel grey scale statistical brightness between adjacent display partitions in adjacent display modules, there will be a difference in brightness between adjacent backlight partitions corresponding to the adjacent display partitions, thereby leading to a problem of uneven brightness in a spliced display device.

SUMMARY

According to an exemplary embodiment, there is provided a backlight control method for a spliced display device. The spliced display device comprises a plurality of display modules including respective backlight modules. Each of the backlight modules comprises a plurality of backlight partitions, including a first backlight partition located at edge of a corresponding backlight module of the backlight modules. The method comprises: for a first backlight partition of a backlight module: obtaining an initial brightness value and a reference brightness value for the first backlight partition; adjusting the initial brightness value of the first backlight partition according to the reference brightness value to obtain an adjusted brightness value for the first backlight partition; and controlling brightness of the first backlight partition according to the adjusted brightness value.

In some exemplary embodiments, the plurality of display modules include a first display module and a second display module. The first display module comprises a first backlight module, and the second display module comprises a second backlight module. The second backlight module comprises a second backlight partition located at edge of the second backlight module and adjacent to the first backlight partition located at edge of the first backlight module. Obtaining the reference brightness value for the first backlight partition located at edge of the first backlight module comprises: obtaining the initial brightness value of the second backlight partition as the reference brightness value for the first backlight partition located at edge of the first backlight module.

In some exemplary embodiments, obtaining the initial brightness value of the first backlight partition located at edge of the corresponding backlight module comprises: obtaining the initial brightness value for the first backlight partition located at edge of the corresponding backlight module according to a dynamic local dimming algorithm for the corresponding backlight module.

In some exemplary embodiments, obtaining the initial brightness value for the first backlight partition located at edge of the corresponding backlight module comprises: obtaining the initial brightness value for the first backlight partition located at edge of the corresponding backlight module according to pixel grey scale statistical brightness of a display partition that corresponds to the first backlight partition located at edge of the corresponding backlight module.

In some exemplary embodiments, obtaining the initial brightness value of the second backlight partition comprises: receiving initial brightness values of backlight partitions located at edges of other backlight modules than the first backlight module of the plurality of display modules; and selecting the initial brightness value of the second backlight partition located at edge of the second backlight module from the received initial brightness values.

In some exemplary embodiments, selecting the initial brightness value of the second backlight partition located at edge of the second backlight module comprises: selecting the initial brightness value of a second backlight partition(s) that is located at edge of the second backlight module and adjacent to the first backlight module along at least one direction.

In some exemplary embodiments, the at least one direction comprises at least one selected from a group consisting of the horizontal direction and the vertical direction.

In some exemplary embodiments, adjusting the initial brightness value of the first backlight partition comprises: calculating the adjusted brightness value of the first backlight partition according to a formula: $a_1=a_0*[1-(a_0-b_0)/(a_0+b_0)]$, wherein $a_1$ is the adjusted brightness value of the first backlight partition, $a_0$ is the initial brightness value of the first backlight partition and $b_0$ is the reference brightness value.

According to an exemplary embodiment, there is provided a spliced display device comprising a plurality of display modules. The plurality of display modules comprises respective backlight modules. Each of the backlight modules comprises a plurality of backlight partitions, including a first backlight partition located at edge of a corresponding one of the backlight modules. Each of the backlight modules further comprises: a light source configured to emit light so as to output a backlight; a brightness adjuster configured to obtain an initial brightness value and a reference brightness value for the first backlight partition, and adjust the initial brightness value of the first backlight partition according to the reference brightness value to obtain an adjusted brightness value of the first backlight partition; and a controller configured to drive the light source to emit light according to the adjusted brightness value so as to control brightness of the first backlight partition.

In some exemplary embodiments, the plurality of display modules comprise a first display module and a second display module. The first display module comprises a first backlight module, and the second display module comprises a second backlight module. The second backlight module comprises a second backlight partition located at edge of the second backlight module and adjacent to the first backlight partition located at edge of the first backlight module. The brightness adjuster of the first backlight module is configured to obtain the initial brightness value of the second backlight partition as the reference brightness value of the first backlight partition located at edge of the first backlight module.

In some exemplary embodiments, each of the display modules further comprises a plurality of display partitions with each corresponding to a respective backlight partition of the plurality of backlight partitions in the backlight module.

In some exemplary embodiments, the brightness adjuster is configured to obtain the initial brightness value for the first backlight partition located at edge of the corresponding backlight module according to a dynamic local dimming algorithm of the corresponding backlight module.

In some exemplary embodiments, the brightness adjuster is configured to obtain the initial brightness value of the respective backlight partition according to pixel grey scale statistical brightness of a display partition corresponding to the first backlight partition located at edge of the corresponding backlight module.

In some exemplary embodiments, the plurality of display modules are arranged in a matrix, and the first backlight module is adjacent to at least one of second backlight modules along at least one direction.

In some exemplary embodiments, the first display module further comprises a data transmission unit configured to transmit the initial brightness value of the first backlight partition of the first backlight module to one or more other backlight modules in the display device, and receive the initial brightness value of a second backlight partition from a second backlight module.

In some exemplary embodiments, the brightness adjuster is configured to calculate the adjusted brightness value according to a formula: $a_1=a_0*[1-(a_0-b_0)/(a_0+b_0)]$, wherein $a_1$ is the adjusted brightness value of the first backlight partition, $a_0$ is the initial brightness value of the first backlight partition and $b_0$ is the reference brightness value.

According to an exemplary embodiment, there is provided a computer-readable storage medium storing a computer program, which, when executed by a processor, implements the steps of a method as described above.

According to an exemplary embodiment, there is provided a computer apparatus comprising a memory, a processor and a computer program stored in the memory and runnable on the processor, wherein when the computer program is executed by the processor, the steps of a method as described above are performed.

BRIEF DESCRIPTION OF DRAWINGS

With reference to the following drawings and in combination with the accompanying detailed explanation, the present disclosure will be better understood, and those skilled in the art will better understand the many objectives and advantages of the present disclosure.

DETAILED DESCRIPTION

Figure 1:
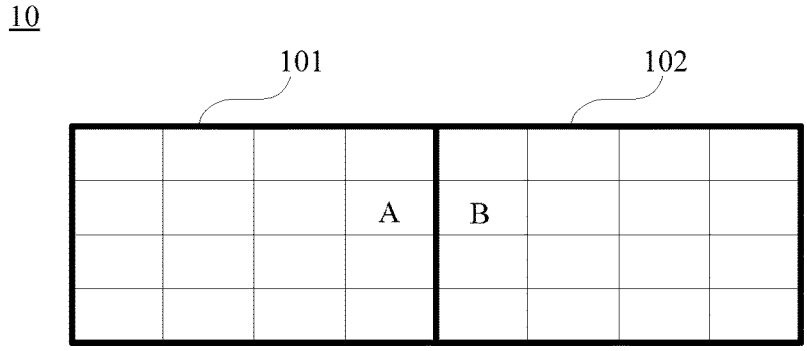
FIG. 1 is a structural schematic view of a spliced display device provided in related art.

The claimed subject matter will now be described with reference to the drawings, wherein the same reference numerals are generally used to denote the same units throughout the text. In the following description, for illustrative purposes, a number of specific details are elaborated in order to provide an understanding of the claimed subject matter. However, it is obvious that the claimed subject matter may also be practiced without these specific details. In other examples, the structure and equipment are illustrated in the block diagram form, so as to easily describe the claimed subject matter.

Exemplary embodiments provide a backlight module and a control method therefor, a spliced display device and a backlight control method as well as a display module thereof, which allows improving display brightness uniformity of a spliced display device.

To this end, exemplary embodiments adopt technical solutions as described hereinafter.

FIG. 1 shows a structural schematic view of a spliced display device provided in related art. As shown in FIG. 1, a spliced display device 10 is formed by splicing a display module 101 and a display module 102. The display module 101 comprises a backlight partition A, and the display module 102 comprises a backlight partition B. The backlight partition A is adjacent to the backlight partition B. The display module 101 controls brightness of the backlight partition A to be at 'a' by using a 3D dynamic local dimming technology according to an image to be displayed thereon. The display module 102 controls brightness of the backlight partition B to be at 'b' by using the 3D dynamic local dimming technology according to the image to be displayed thereon. When there is a difference between pixel grey scale statistical brightness of a display partition corresponding to the backlight partition A and that of a display partition corresponding to the backlight partition B, there is a difference between the brightness 'a' and the brightness 'b', that is, there is a brightness difference between the adjacent backlight partitions A and B. This will lead to uneven brightness in the spliced display device, thus affecting a display effect of the spliced display device.

Figure 2:
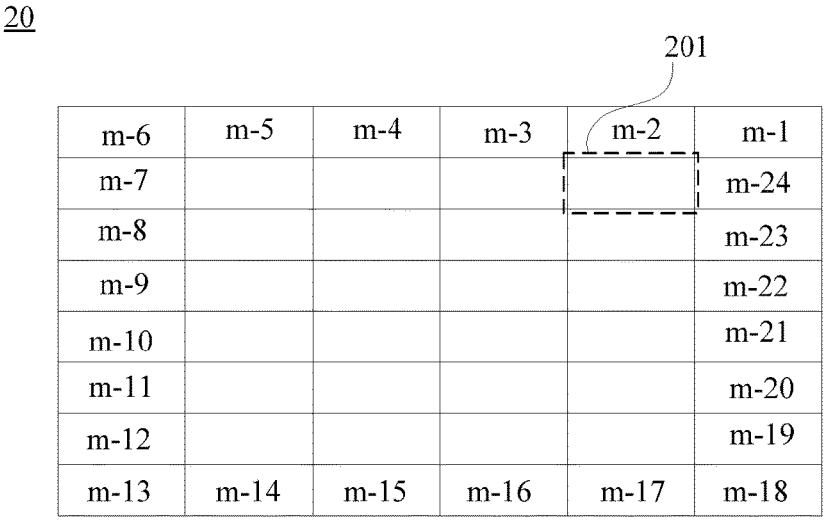
FIG. 2 is a structural schematic view of a backlight module provided according to an exemplary embodiment.

FIG. 2 shows a structural schematic view of a backlight module provided according to an exemplary embodiment. As shown in FIG. 2, a backlight module 20 comprises a plurality of backlight partitions 201. The backlight module 20 may be divided as desired to obtain a different number of backlight partitions 201. FIG. 2 illustrates the backlight module 20 comprising 6×8 backlight partitions 201 as an example. It will be understood that exemplary embodiments are not limited thereto. Instead, there may be other numbers of backlight partitions. A backlight partition 201 may be classified as an edge backlight partition located at edge of the backlight module, for example, the backlight partitions m-1~m-24 at the upper, lower, left and right edges of the backlight module 20, or a non-edge backlight partition in the middle part, based on its position. An edge backlight partition may be adjacent to an edge backlight partition(s) of other backlight module(s) in other display module(s) during splicing of the display modules.

Figure 3:
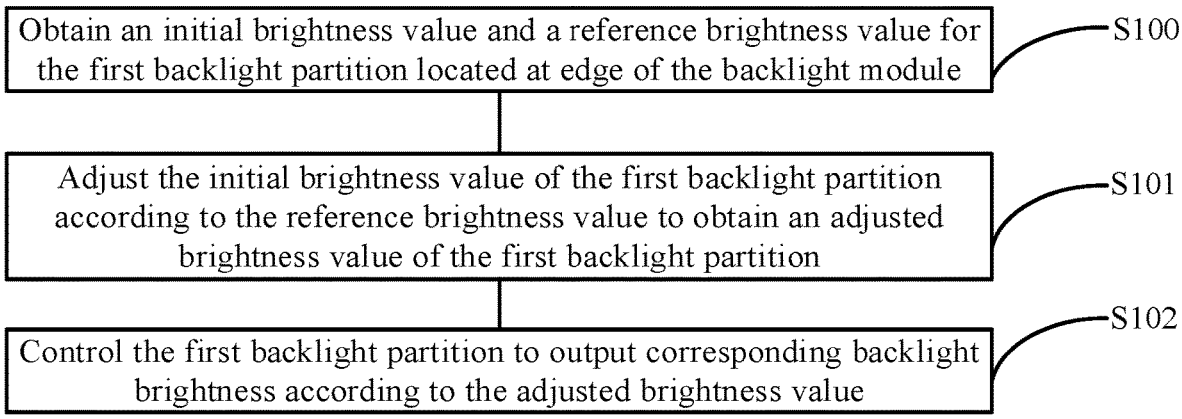
FIG. 3 is a flowchart schematic view of a method for controlling a backlight module provided according to an exemplary embodiment.

FIG. 3 shows a flowchart of a method for controlling a backlight module provided according to an exemplary embodiment. As shown in FIG. 3, the control method for a backlight module comprises the following steps.

S100: An initial brightness value and a reference brightness value for a first backlight partition located at edge of the backlight module are obtained.

Herein, exemplarily, the first backlight partition may be, e.g., any one of the backlight partitions m-1~m-24 as shown in FIG. 2.

The reference brightness value may be a preset brightness value, or an initial brightness value of any of other backlight partitions than the first backlight partition. The other backlight partitions and the first backlight partition may be located in the same backlight module or in different backlight modules. Exemplarily, when a display device is a spliced display device, the spliced display device may comprise a plurality of backlight modules. In this example, the reference brightness value may be the initial brightness value of a second backlight partition. The second backlight partition may be an edge backlight partition that is located at edge of an adjacent backlight module thereof and is adjacent to the first backlight partition.

It will be understood that the number of reference brightness values is not limited to one. Instead, there may be two or more reference brightness values.

The initial brightness value of the first backlight partition may be obtained in different ways.

In an exemplary embodiment, the initial brightness value of the first backlight partition located at edge of the backlight module may be obtained according to a dynamic local dimming algorithm (LD) of the backlight module.

It will be understood that when a backlight module comprises a plurality of backlight partitions, the backlight module may be supplied with a LD function, and may control brightness of an individual backlight partition through the LD function. Exemplarily, the brightness value of an individual backlight partition, including the initial brightness value of the first backlight partition located at edge of the backlight module, may be calculated according to a dynamic local dimming algorithm in the LD function.

In another exemplary embodiment, the initial brightness value of the first backlight partition may be obtained according to pixel grey scale statistical brightness of a display partition to which the first backlight partition corresponds.

It will be understood that a display module usually comprises a display panel and a backlight module. The display panel comprises a plurality of display partitions. The backlight module comprises backlight partitions corresponding to respective display partitions in a one-to-one relationship. Pixel grey scale statistical brightness of a display partition determines an initial brightness value of a backlight partition corresponding to that display partition. Therefore, when the display panel displays an image, an initial brightness value of the first backlight partition may be obtained according to pixel grey scale statistical brightness of a display partition to which the first backlight partition corresponds.

S101: The initial brightness value of the first backlight partition is adjusted according to the reference brightness value so as to obtain an adjusted brightness value of the first backlight partition.

In some exemplary embodiments, the initial brightness value of the first backlight partition may be adjusted according to one reference brightness value or according to two or more reference brightness values.

It shall be understood that the adjustment may be made in any suitable manner such that the difference between the adjusted brightness value of the first backlight partition and the reference brightness value may be reduced.

Optionally, the adjusted brightness value $a_1$ of the first backlight partition may be calculated according to a formula: $a_1=a_0*[1-(a_0-b_0)/(a_0+b_0)]$, wherein $a_0$ is the initial brightness value of the first backlight partition, and $b_0$ is the reference brightness value.

It will be understood that when the initial brightness value of the first backlight partition is adjusted according to two or more reference brightness values, $b_0$ may be the mean value of the two or more reference brightness values, or may be a reference brightness value selected from the two or more reference brightness values.

According to an exemplary embodiment, when the brightness value of the first backlight partition is adjusted according to the formula: $a_1=a_0*[1-(a_0-b_0)/(a_0+b_0)]$, the adjusted brightness value of the first backlight partition varies with the reference brightness value. When the initial brightness value of the first backlight partition is less than the reference brightness value, the adjusted brightness value will be greater than the initial brightness value, i.e., increase towards the reference brightness value, and vice versa. As such, the difference between the adjusted brightness value of the first backlight partition and the reference brightness value will be reduced.

S102: The first backlight partition is controlled according to the adjusted brightness value to output corresponding backlight brightness.

In some exemplary embodiments, when a plurality of display modules is spliced together to form a spliced display device, a backlight module included in an individual display module may be controlled according to the control method for a backlight module as described above. This may reduce the difference between brightness values of adjacent backlight partitions in adjacent backlight modules. Exemplarily, if the first backlight partition is located at edge of a first backlight module, the reference brightness value may be an initial brightness value of a second backlight partition located at edge of a second backlight module adjacent to the first backlight module in the spliced display device. The second backlight partition is adjacent to the first backlight partition. According to embodiments of the present disclosure, in the spliced display device, the brightness value of the first backlight partition in the first backlight module is adjusted with reference to the initial brightness value of the second backlight partition in the adjacent second backlight module. In this way, the difference between the adjusted brightness values of the adjacent backlight partitions may be reduced, so as to implement adjustment of brightness values of adjacent backlight partitions across backlight modules, and then improve the brightness uniformity of the spliced display device.

It may be understood that when the image displayed on display panels in a spliced display device changes, the initial brightness value of the first backlight partition will change. Thus, the adjustment of the brightness value according to embodiments of the present disclosure may be performed when a change in the initial brightness value of the first backlight partition is detected. Additionally, the adjustment of the brightness value according to embodiment of the present disclosure may further be performed when a change in the reference brightness value is detected. Additionally or alternatively, the adjustment of the brightness value according to embodiments of the present disclosure may further be performed at a certain time interval. In this way, the brightness value of the first backlight partition may be dynamically and real-time adjusted in response to the change in the initial brightness value and the reference brightness value of the first backlight partition.

Figure 4:
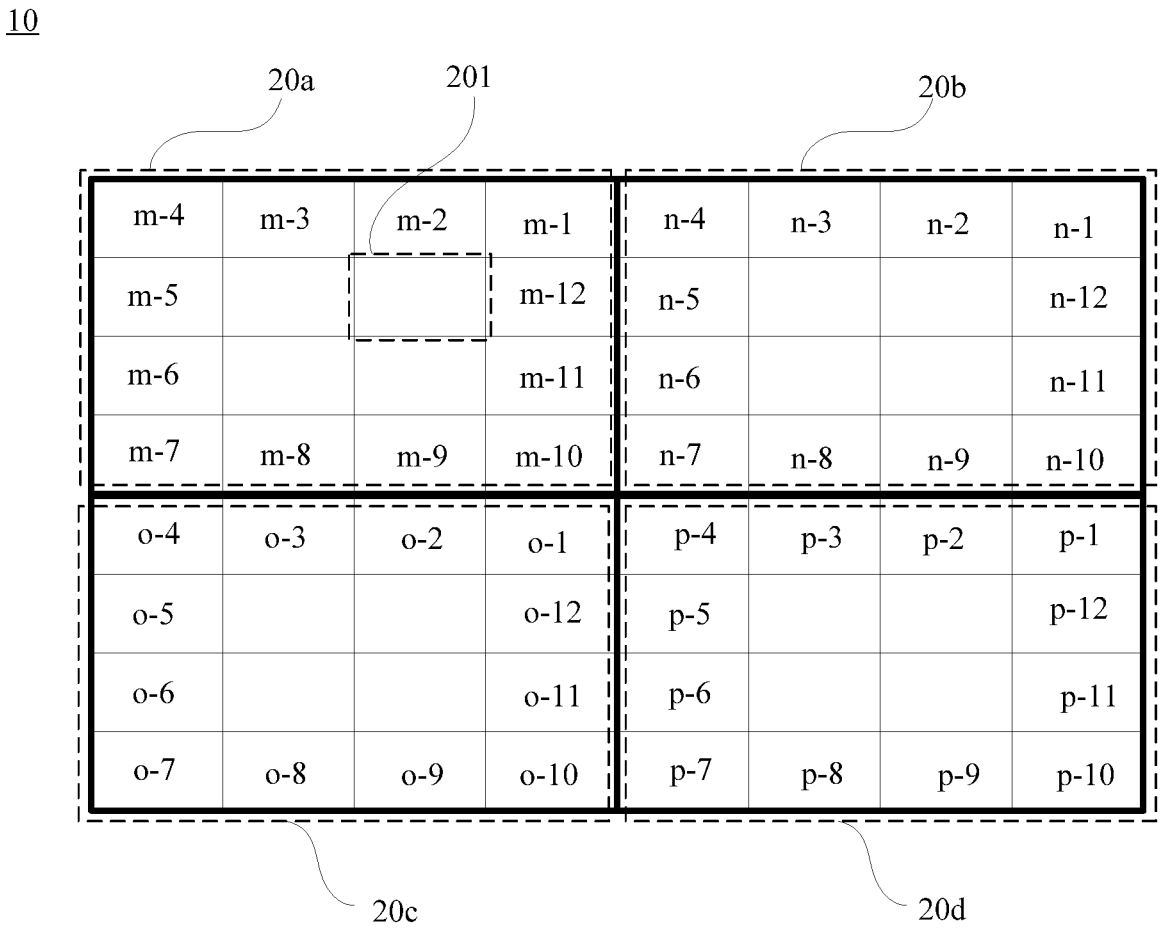
FIG. 4 is a structural schematic view of a display device provided according to an exemplary embodiment.

As shown in FIG. 4, the spliced display device 10 comprises a plurality of display modules. A display module will be in a splicing relationship with adjacent n 4 display modules. A display module comprises a display panel and a backlight module 20 (the display panel is not shown in FIG. 4, and FIG. 4 illustrates a spliced display device 10 comprising 2×2=4 backlight modules 20*a*, 20*b*, 20*c* and 20*d* for example).

A backlight control method for the spliced display device 10 comprises performing a control method for individual backlight modules 20*a*, 20*b*, 20*c* and 20*d* according to the control method for a backlight module as mentioned above. The first backlight partition is located at edge of the first backlight module. The reference brightness value is an initial brightness value of a second backlight partition located at edge of a second backlight module. The second backlight module is one of the plurality of backlight modules 20 that is adjacent to the first backlight module, and the second backlight partition is adjacent to the first backlight partition.

It will be understood that when the spliced display device 10 comprises a plurality of display modules and each of the display modules comprises backlight modules 20, for the sake of splicing, in some embodiments, the backlight modules 20 in the spliced display device 10 are the same in size, and adjacent edges of adjacent backlight modules 20 comprise the same number of backlight partitions 201.

Exemplarily, as shown in FIG. 4, when the spliced display device 10 comprises four backlight modules 20, which are backlight module 20*a*, backlight module 20*b*, backlight module 20*c* and backlight module 20*d* respectively, the control methods for backlight module 20*a*, backlight module 20*b*, backlight module 20*c* and backlight module 20*d* are all performed according to the control method for a backlight module as stated above. When backlight module 20*a* is the first backlight module, the first backlight partition may be m-1, m-7 to m-12, and the second backlight module may be backlight module 20*b* and backlight module 20*c*. When a control method for backlight module 20*b* is performed according to the control method for a backlight module as stated above, backlight module 20*b* is the first backlight module, and so on.

Here, for adjacent backlight partitions located in adjacent backlight modules, initial brightness values of the adjacent backlight partitions may be adjusted simultaneously, or the initial brightness value of one of the adjacent backlight partitions may be adjusted first, and then the initial brightness value of another backlight partition may be adjusted. Here, when an initial brightness value of a backlight partition is referred to, it is intended to refer to a brightness value of that backlight partition before adjustment, rather than an adjusted brightness value, irrespective of whether the initial brightness values of the adjacent backlight partitions located in the adjacent backlight modules are adjusted simultaneously or sequentially.

In the spliced display device 10, when a brightness value of a first backlight partition of any backlight module is adjusted, there may be one or more second backlight partitions adjacent to the first backlight partition. Exemplarily, as shown in FIG. 4, when a brightness value of a first backlight partition o-2 in backlight module 20*c* is adjusted, the first backlight module is backlight module 20*c*, and the second backlight partition may be backlight partition m-9 located in backlight module 20*a*. When a brightness value of a first backlight partition o-1 in backlight module 20*c* is adjusted, the second backlight partition may be backlight partition m-10 located in backlight module 20*a* and backlight partition p-4 located in backlight module 20*d*. In some embodiments, for the first backlight partition o-1, the second backlight partition may also be backlight partition n-7 located in backlight module 20*b*.

On this basis, when an initial brightness value of a first backlight partition is adjusted, if there is one second backlight partition adjacent to the first backlight partition, the initial brightness value of the first backlight partition is adjusted according to the initial brightness value of this second backlight partition. If the first backlight partition is adjacent to a plurality of second backlight partitions, the initial brightness value of the first backlight partition may be adjusted according to the initial brightness value of one of the plurality of second backlight partitions, or according to the initial brightness values of multiple second backlight partitions. In some embodiments, the initial brightness value of the first backlight partition may be adjusted according to the mean value of the initial brightness values of the plurality of second backlight partitions. Exemplarily, as shown in FIG. 4, when the first backlight partition o-1 in backlight module 20*c* is adjusted, the initial brightness value of the first backlight partition o-1 may be adjusted according to the initial brightness value of backlight partition p-4 located in backlight module 20*d*; or the initial brightness value of the first backlight partition o-1 may be adjusted according to the initial brightness value of backlight partition m-10 located in backlight module 20*a*. Alternatively, the initial brightness value of the first backlight partition o-1 may also be adjusted according to both the initial brightness value of backlight partition m-10 located in backlight module 20*a* and the initial brightness value of backlight partition p-4 located in backlight module 20*d*.

On this basis, since brightness values of edge backlight partitions of an individual backlight modules 20 may be adjusted according to an initial brightness value of its adjacent backlight partition located in an adjacent backlight module, the difference between the adjusted brightness values of adjacent edge backlight partitions of adjacent backlight modules decreases, that is, the adjusted brightness values of the adjacent edge backlight partitions of the adjacent backlight modules tend to be close with each other. Exemplarily, backlight module 20*a* is adjacent to backlight module 20*b*, and backlight partition m-12 in backlight module 20*a* is adjacent to backlight partition n-5 in backlight module 20*b*. The initial brightness value of backlight partition m-12 is $s_0$, and the initial brightness value of backlight partition n-5 is $t_0$. While the initial brightness value $s_0$ of backlight partition m-12 is adjusted according to the initial brightness value to of backlight partition n-5, the initial brightness value to of backlight partition n-5 may be adjusted according to the initial brightness value $s_0$ of backlight partition m-12. In this way, the difference between the adjusted brightness value of backlight partition m-12 and the adjusted brightness value of backlight partition n-5 will be reduced. Furthermore, if the adjusted brightness value of the first backlight partition is calculated according to the above formula: $a_1=a_0*[1-(a_0-b_0)/(a_0+b_0)]$, the adjusted brightness value of backlight partition m-12 is $s_1=s_0*[1-(s_0-t_0)/(s_0+t_0)]$, and the adjusted brightness value of backlight partition n-5 is $t_1=t_0[1-(t_0-s_0)/(t_0+s_0]$. It can thus be seen that the adjusted brightness value of backlight partition m-12 makes reference to the initial brightness value of its adjacent backlight partition n-5, and the adjusted brightness value of the backlight partition n-5 makes reference to the initial brightness value of its adjacent backlight partition m-12. After adjustment, the brightness value of the backlight partition having a larger initial brightness value will decrease towards the initial brightness value of the other backlight partition, and vice versa (generally speaking, so will not be equal to $t_0$). As a result, the difference between adjusted brightness values of backlight partition m-12 and backlight partition n-5 decreases with respect to the difference between initial brightness values of backlight partition m-12 and backlight partition n-5. Under ideal conditions, the adjusted brightness value of backlight partition m-12 will be equal to that of backlight partition n-5, i.e., being $2t_0s_0/(t_0+s_0)$.

It will be understood that, for adjacent edges of adjacent backlight modules 20, since the difference between adjusted brightness values of adjacent backlight partitions 201 in adjacent backlight modules 20 decreases, the difference between brightness values at the adjacent edges of adjacent backlight modules 20 is reduced. Exemplarily, as shown in FIG. 4, a lower edge of backlight module 20*a* is adjacent to an upper edge of backlight module 20*c*. The difference between the brightness value of backlight partition m-7 adjusted according to backlight partition o-4 and the brightness value of backlight partition o-4 adjusted according to backlight partition m-7 decreases, the difference between the brightness value of backlight partition m-8 adjusted according to backlight partition o-3 and the brightness value of backlight partition o-3 adjusted according to backlight partition m-8 decreases, the difference between the brightness value of backlight partition m-9 adjusted according to backlight partition o-2 and the brightness value of backlight partition o-2 adjusted according to backlight partition m-9 decreases, and the difference between the brightness value of backlight partition m-10 adjusted according to backlight partition o-1 and the brightness value of backlight partition o-1 adjusted according to backlight partition m-10 decreases. As such, the brightness difference between the lower edge of backlight module 20*a* and the upper edge of backlight module 20*c* is reduced.

In the spliced display device 10 and during adjustment of initial brightness values of edge backlight partitions of a backlight module, initial brightness values of one or more of the edge backlight partitions in this backlight module 201 that are adjacent to edge backlight partitions of adjacent backlight modules may be adjusted. The adjusted backlight partitions may be referred to as the first backlight partition. That is to say, one or more of the edge backlight partitions 201 in the backlight module 20 that are adjacent to edge backlight partitions of adjacent backlight modules may be used as the first backlight partition. Exemplarily, as shown in FIG. 4, backlight partitions of backlight module 20*a* that are adjacent to edge backlight partitions of adjacent backlight modules may comprise m-7~m-12 and m-1. The initial brightness value of one or more of backlight partitions m-7~m-12 and m-1 may be adjusted, that is, one or more of backlight partitions m-7~m-12 and m-1 may be used as the first backlight partition.

Optionally, the ones of edge backlight partitions 201 in a backlight module 20 that are adjacent to edge backlight partitions 201 of adjacent backlight modules 20 are all used as the first backlight partition. In some exemplary embodiments, the initial brightness values of all the first backlight partitions are adjusted. In another exemplary embodiment, the brightness value is adjusted only if the difference between the initial brightness value and the reference brightness value of the first backlight partition is greater than a certain threshold. This will save processing resources used for brightness adjustment and improve response speed of brightness adjustment for the whole backlight module.

In exemplary embodiments, since the ones of a plurality of edge backlight partitions in a backlight module that are adjacent to edge backlight partitions of adjacent backlight modules are all used as the first backlight partition and then adjusted, which means that the initial brightness values of the ones of the plurality of edge backlight partitions in the backlight module that are adjacent to edge backlight partitions of adjacent backlight modules are all adjusted, the brightness difference between adjacent backlight partitions of different backlight modules is reduced, thereby ensuring the brightness uniformity in the spliced display device.

In exemplary embodiments, when a control method is performed for an individual backlight module 20 in the spliced display device according to the control method for a backlight module as described above, the reference brightness value (for example, the initial brightness value of the second backlight partition located at edge of the second backlight module) of the backlight module may be obtained in any suitable way. Optionally, initial brightness values of edge backlight partitions of other backlight modules 20 than the first backlight module may be received, and the initial brightness value of the second backlight partition located at edge of the second backlight module may be selected from the received initial brightness values, where the second backlight module is adjacent to the first backlight module, and the second backlight partition is adjacent to the first backlight partition.

A backlight module 20 here may first obtain the initial brightness values of the edge backlight partitions of other backlight modules, and then select, from the initial brightness values of the edge backlight partitions of other backlight modules, the initial brightness values of the backlight partitions that are adjacent to edge backlight partitions of the backlight modules 20. Exemplarily, as shown in FIG. 4, when backlight module 20*a* is the first backlight module, backlight module 20*a* first obtains the initial brightness values of backlight partitions 201 located at edges of backlight module 20*b*, backlight module 20*c* and backlight module 20*d*, that is, obtains the initial brightness values of backlight partitions n-1~n-12, backlight partitions o-1~o-12 and backlight partitions p-1~p-12, and then selects and stores the initial brightness values of the backlight partitions that are adjacent to edge backlight partitions (such as m-1~m-12) of backlight module 20*a* from the initial brightness values of these backlight partitions 201, e.g., select the initial brightness values of backlight partitions n-4~n-7 and backlight partitions o-1~o-4. Furthermore, when the first backlight partition is m-1, the initial brightness value of the second backlight partition n-4 is selected; when the first backlight partition is m-12, the initial brightness value of the second backlight partition n-5 is selected; and so on. Similarly, when backlight module 20*b* is the first backlight module, backlight module 20*c* is the first backlight module, or backlight module 20*d* is the first backlight module, a corresponding second backlight partition may be selected for the first backlight partition in a same way.

In exemplary embodiments, since each backlight module 20 may receive initial brightness values of edge backlight partitions of other backlight modules 20, when a backlight module 20 is the first backlight module, it may obtain a corresponding initial brightness value of a second backlight partition located at edge of a second backlight module.

Adjustment of an initial brightness value of a first backlight partition according to initial brightness values of two or more second backlight partitions may complicate the adjustment process. As such, in some exemplary embodiments, when a backlight module 20 comprises a plurality of backlight partitions 201 arranged in a matrix, and in the case that a first backlight module is adjacent to a plurality of second backlight modules and then a first backlight partition is adjacent to a plurality of second backlight partitions, one of the plurality of backlight modules 20 that is horizontally or vertically adjacent to the first backlight module is selected as the second backlight module, and a backlight partition of the second backlight module that is horizontally or vertically adjacent to the first backlight partition is correspondingly selected as the second backlight partition.

In a plane formed by the spliced display device, the horizontal direction may comprise a horizontally leftward direction and a horizontally rightward direction, and the vertical direction may comprise an upward direction and a downward direction perpendicular to the horizontal direction.

Exemplarily, with reference to FIG. 4, when the first backlight module is backlight module 20*c* and the first backlight partition is o-1, the second backlight partition is p-4 if the second backlight module is backlight module 20*d* adjacent to the first backlight module in a horizontal direction; or the second backlight partition is m-10 if the second backlight module is backlight module 20*a* adjacent to the first backlight module in a vertical direction.

It will be understood that for any of backlight modules 20 that is used as the first backlight module, the second backlight module may be a backlight module adjacent to the first backlight module in a horizontal direction, or a backlight module adjacent to the first backlight module in a vertical direction. In embodiments of the disclosure, optionally, when a backlight module 20 in the spliced display device 10 is used as the first backlight module, a backlight module adjacent to the first backlight module in a horizontal direction may be selected as the second backlight module, or a backlight module adjacent to the first backlight module in a vertical direction may be selected as the second backlight module. Exemplarily, as shown in FIG. 4, given that a backlight module adjacent to the first backlight module in a vertical direction will be selected as the second backlight module, backlight module 20*c* is the second backlight module if backlight module 20*a* is the first backlight module; backlight module 20*a* is the second backlight module if backlight module 20*c* is the first backlight module; backlight module 20*d* is the second backlight module if backlight module 20*b* is the first backlight module; or backlight module 20*b* is the second backlight module if backlight module 20*d* is the first backlight module.

In exemplary embodiments, since one of the plurality of backlight modules 20 that is adjacent to the first backlight module in a horizontal or vertical direction is intended to be the second backlight module, there is only one second backlight partition adjacent to the first backlight partition located at edge of the first backlight module, and then it is only required to adjust the initial brightness value of the first backlight partition according to the initial brightness value of such a second backlight partition, thereby simplifying the process of adjusting the initial brightness value of the first backlight partition.

Figure 5:
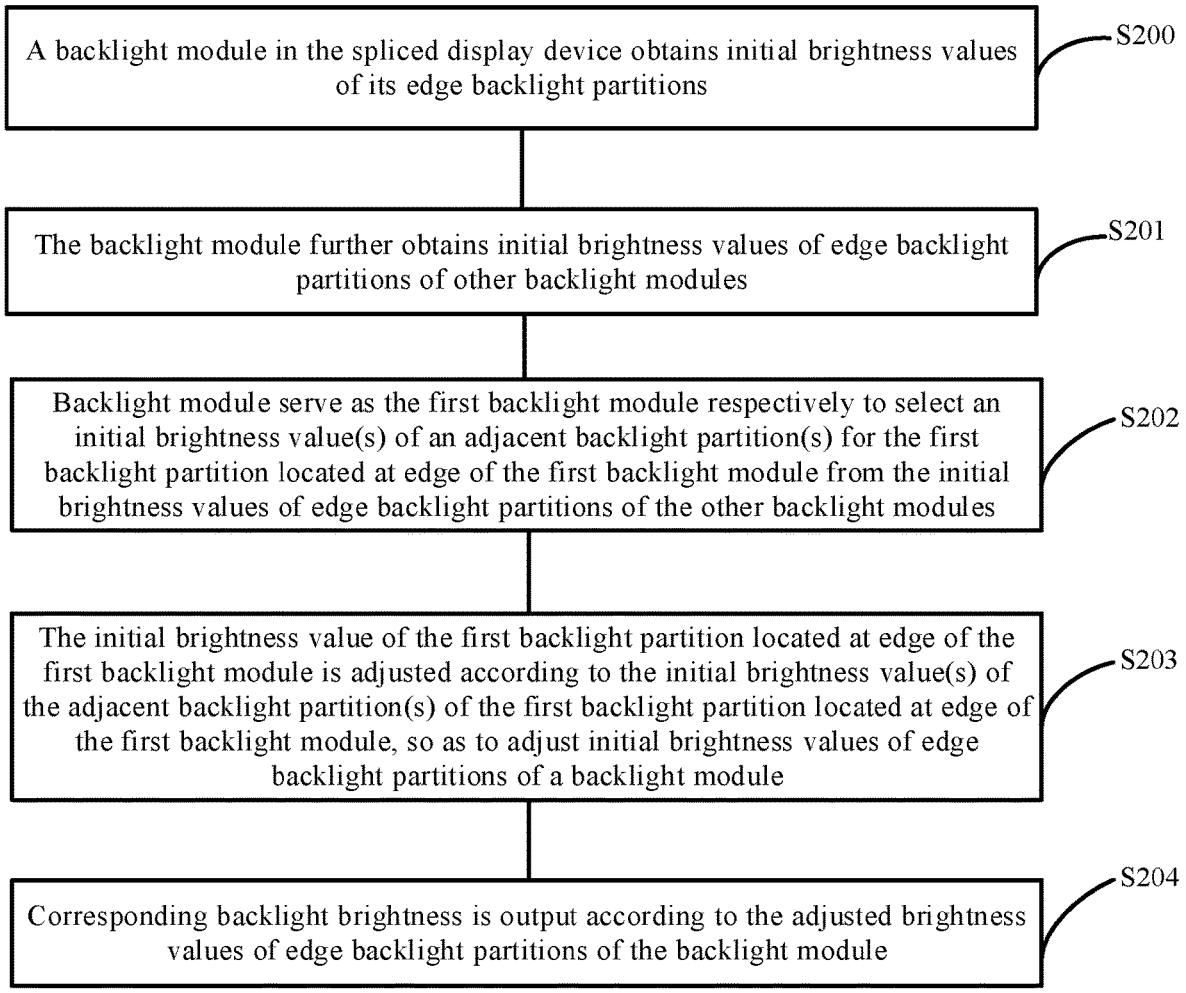
FIG. 5 is a flowchart schematic view of a backlight control method for the display device provided according to an exemplary embodiment.

FIG. 5 shows a backlight control method for a spliced display device 10 provided according to an exemplary embodiment. As shown in FIG. 5, in S200, a backlight module 20 of the spliced display device 10 obtains initial brightness values of its edge backlight partitions. Optionally, it is possible to only obtain the initial brightness values of backlight partitions located at edges where adjacent backlight modules exist. This helps to reduce the amount of data to be processed, thereby improving the processing speed. In S201, the backlight module 20 further obtains initial brightness values of edge backlight partitions of other backlight modules in the spliced display device. Optionally, it is possible to only obtain the initial brightness values of edge backlight partitions of its adjacent backlight modules. In some exemplary embodiments, it is also possible to only obtain the initial brightness values of the edge backlight partitions of backlight modules adjacent to it in one or more particular directions. In S202, backlight modules 20 are used as the first backlight module respectively, and an initial brightness value(s) of a backlight partition(s) adjacent to a first backlight partition located at edge of the first backlight module is selected from the initial brightness values of the edge backlight partitions of the other backlight modules. In some embodiments, it is possible to only select the initial brightness value(s) of the backlight partition(s) adjacent to the first backlight partition in one or more particular directions. In S203, the initial brightness value of the first backlight partition located at the edge of the first backlight module is adjusted according to the initial brightness values of the backlight partitions that are adjacent to the first backlight partition located at edge of the first backlight module. In this way, the initial brightness values of edge backlight partitions of each backlight module are adjusted. In S204, corresponding backlight brightness is outputted according to the adjusted brightness values of the edge backlight partitions of the backlight module.

Figure 6:
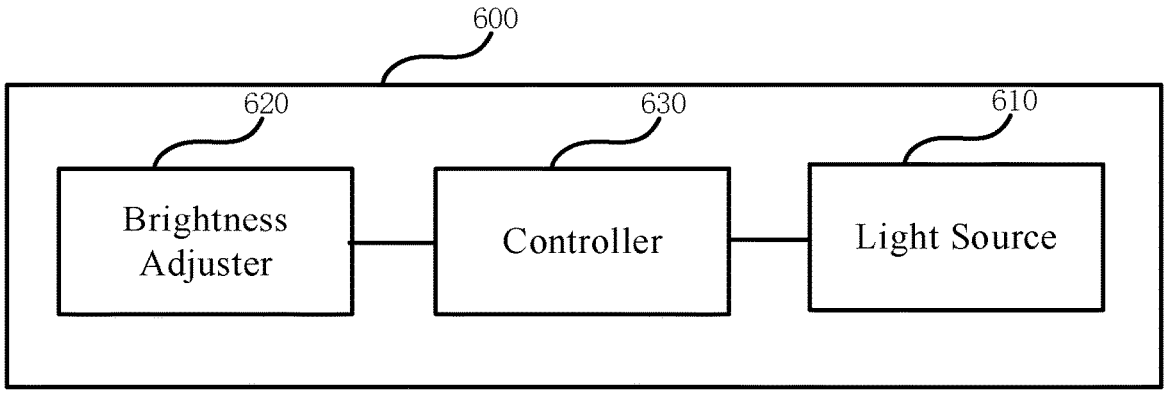
FIG. 6 is a structural block diagram of a backlight module provided according to an exemplary embodiment.

FIG. 6 shows a backlight module 600 provided according to an embodiment of the present disclosure. As shown in FIG. 6, the backlight module 600 comprises a light source 610, a brightness adjuster 620 and a controller 630.

The light source 610 is configured to emit light. Optionally, the light source 610 may be, e.g., an incandescent bulb, an electric light panel (ELP), a light-emitting diode (LED), a cold cathode fluorescent lamp (CCFL).

The brightness adjuster 620 is configured to obtain an initial brightness value and a reference brightness value for a first backlight partition located at edge of the backlight module 600, and adjust the initial brightness value of the first backlight partition according to the reference brightness value to obtain the adjusted brightness value of the first backlight partition.

It will be understood that the brightness adjuster 620 may be implemented by a processor. The processor 30 may be, for example, an SOC (System on Chip).

The brightness adjuster 620 is configured to obtain an initial brightness value of a first backlight partition located at edge of a backlight module in any suitable way.

In an example, the brightness adjuster 620 is configured to obtain the initial brightness value of the first backlight partition located at edge of the backlight module according to a dynamic local dimming algorithm for the backlight module.

In this example, the backlight module 20 comprises a plurality of backlight partitions 201, and when the backlight module 20 is supplied with a LD function, the brightness of an individual backlight partition is controlled through the LD function. On this basis, since the brightness value of an individual backlight partition may be calculated according to a dynamic local dimming algorithm of the LD function, the brightness adjuster 620 may obtain the initial brightness value of the first backlight partition located at edge of the backlight module according to the dynamic local dimming algorithm of the backlight module. In some embodiments, a program for implementing the dynamic local dimming algorithm in the LD function may be integrated into the brightness adjuster 620 of a backlight module 20, or may be arranged in a separate LD processor (which is a processor different from the brightness adjuster 620). The LD processor may be communicatively connected with the brightness adjuster 620 of the backlight module 20. In the latter case, the initial brightness value of the first backlight partition located at edge of the backlight module may be calculated according to a dynamic local dimming algorithm in the LD processor, and then the initial brightness value of the first backlight partition is transmitted to the brightness adjuster 620 of the backlight module 20. In an example, the initial brightness value of the first backlight partition may be transmitted to the brightness adjuster 620 through SPI (serial peripheral interface) serial port data.

In another example, the brightness adjuster 620 may be configured to obtain the initial brightness value of the first backlight partition according to pixel grey scale statistical brightness of a display partition corresponding to the first backlight partition located at edge of the backlight module.

In some exemplary embodiments, the display module comprises a display panel and a backlight module. The display panel comprises a plurality of display partitions. For each display partition, backlight module 20 comprises a corresponding backlight partition 201. Since the pixel grey scale statistical brightness of a display partition determines the initial brightness value of its corresponding backlight partition 201, when the first backlight module displays an image, the brightness adjuster 620 may obtain the initial brightness value of the first backlight partition located at edge of the first backlight module according to the pixel grey scale statistical brightness of the display partition corresponding to that first backlight partition.

In addition to the initial brightness value of the first backlight partition located at edge of the first backlight module, the brightness adjuster 620 may further obtain initial brightness values of backlight partitions located at other positions of the first backlight module. When an image is displayed on the display panel, the brightness adjuster 620 may first calculate the initial brightness values of backlight partitions according to pixel grey scale statistical brightness of display partitions, and then select the initial brightness value of the first backlight partition located at edge of the first backlight module from the initial brightness values of the backlight partitions.

In exemplary embodiments, the brightness adjuster 620 may adjust the initial brightness value of the first backlight partition according to the reference brightness value in any suitable way, as far as the difference between the adjusted brightness value of the first backlight partition and the reference brightness value is reduced. Optionally, the brightness adjuster 620 is configured to calculate the adjusted brightness value of the first backlight partition according to a formula: $a_1=a_0*[1-(a_0-b_0)/(a_0+b_0)]$, wherein $a_1$ is the adjusted brightness value of the first backlight partition, $a_0$ is the initial brightness value of the first backlight partition, and $b_0$ is the reference brightness value.

According to exemplary embodiments, when the brightness value of the first backlight partition is adjusted according to the formula: $a_1=a_0*[1-(a_0-b_0)/(a_0+b_0)]$, the adjusted brightness value of the first backlight partition is related to the reference brightness value, and the brightness value of the first backlight partition changes towards the reference brightness value. Thus, the difference between the adjusted brightness value of the first backlight partition and the reference brightness value will be reduced.

The controller 630 is configured to receive the adjusted brightness value of the first backlight partition from the brightness adjuster 620, and control emission of the light source 610 according to the adjusted brightness value that is received, so that the first backlight partition outputs the corresponding backlight brightness. The controller 630 may be, for example, a backlight driven control MCU (Microcontroller Unit).

After the brightness adjuster 620 (for example, the SOC) transmits the obtained adjusted brightness value of the first backlight partition to the controller 630 (for example, a backlight driven control MCU), the controller 630 may drive the light source 610 to emit light according to the adjusted brightness value of the first backlight partition so as to control the first backlight partition to output corresponding backlight brightness.

It will be understood that all the possibilities discussed above with respect to FIGS. 2 to 5 are also valid for FIG. 6.

Exemplary embodiments also provides a display module, comprising a display panel and a backlight module as stated above. The display panel comprises a plurality of display partitions with each corresponding to a backlight partition.

The display panel may be of any suitable type. Exemplarily, the display panel may be any non-autonomous luminous display panel such as a liquid crystal display panel or an electrophoretic display panel.

Exemplary embodiments also provides a display device 10, comprising a plurality of display modules as described above, which are spliced together. The reference brightness value of a first backlight partition located at edge of a first backlight module in a display module is the initial brightness value of a second backlight partition located at edge of a second backlight module in the display module. The second backlight module is adjacent to the first backlight module, and the second backlight partition is adjacent to the first backlight partition.

It will be understood that when the spliced display device 10 comprises a plurality of display modules, for the sake of splicing, it is possible to make various backlight modules 20 in the plurality of display modules be of the same size, and the adjacent edges of adjacent backlight modules 20 have the same number of backlight partitions 201.

In some exemplary embodiments, when a first backlight partition located at edge of a first backlight module is adjacent to a plurality of second backlight partitions, and each of the second backlight partitions is located at edge of a second backlight module that is adjacent to the first backlight module, the brightness value of the first backlight partition located at edge of the first backlight module may be adjusted according to one or more of the plurality of second backlight partitions.

In these exemplary embodiments, since a brightness value of an edge backlight partition of a backlight modules 20 in a display module may be adjusted according to an initial brightness value of its adjacent backlight partition in an adjacent backlight module, the difference between brightness values of adjacent edge backlight partitions of adjacent backlight modules decreases after adjustment, that is, the adjusted brightness values of the adjacent edge backlight partitions of the adjacent backlight modules tend to be close to each other. Exemplarily, as shown in FIG. 4, backlight module 20*a* is adjacent to backlight module 20*b*, backlight partition m-12 in backlight module 20*a* is adjacent to the backlight partition n-5 in backlight module 20*b*. The initial brightness value of backlight partition m-12 is $s_0$, and the initial brightness value of the backlight partition n-5 is $t_0$. As such, while the initial brightness value to of backlight partition n-5 is adjusted according to the initial brightness value $s_0$ of backlight partition m-12 so as to make the brightness value of the backlight partition n-5 change towards $s_0$, the initial brightness value $s_0$ of backlight partition m-12 may be adjusted according to the initial brightness value $t_0$ of backlight partition n-5 so as to make the brightness value of backlight partition m-12 change towards $t_0$. As a result, the difference between the brightness value of backlight partition m-12 and the brightness value of the backlight partition n-5 will decrease after adjustment.

According to exemplary embodiments, the difference between brightness values of adjacent backlight partitions in adjacent backlight modules decreases after adjustment. This improves brightness uniformity among a plurality of backlight modules 20, and in turn improves brightness uniformity of a spliced display device provided according to the embodiment of the present disclosure, thereby enhancing a display effect of the spliced display device.

Optionally, in a spliced display device, all of the edge backlight partitions of a backlight module that are adjacent to edge backlight partitions of adjacent backlight modules may be treated as the first backlight partition.

In exemplary embodiments, since all of the edge backlight partitions of a backlight module that are adjacent to edge backlight partitions of adjacent backlight modules may be treated as the first backlight partition, each of the edge backlight partitions of the backlight module that adjacent to edge backlight partitions of adjacent backlight modules may be adjusted to ensure the brightness uniformity of the spliced display device.

In case a first backlight partition is adjacent to a plurality of second backlight partitions, when the initial brightness value of the first backlight partition is adjusted, the initial brightness value of the first backlight partition may be adjusted according to an initial brightness value of one of the second backlight partitions. Alternatively, the initial brightness value of the first backlight partition may also be adjusted according to initial brightness values of two or more second backlight partitions. In some embodiments, in order to simplify adjustment of the initial brightness value of the first backlight partition, in an event that the backlight module 20 comprises a plurality of backlight partitions 201 arranged in a matrix, a first backlight module is adjacent to a plurality of second backlight modules and a first backlight partition is adjacent to a plurality of second backlight partitions, one of the plurality of backlight modules 20 that is adjacent to the first backlight module along a certain direction (such as a horizontal direction or a vertical direction) may be selected as the second backlight module, and one of the backlight partitions in the second backlight module that is adjacent to the first backlight partition along the certain direction is correspondingly selected as the second backlight partition.

In exemplary embodiments, since the second backlight module is intended to be a backlight module out of the plurality of backlight modules 20 that is adjacent to the first backlight module in a horizontal or vertical direction, there is only one second backlight partition for the first backlight partition located at edge of the first backlight module, which is adjacent to the first backlight partition. In this way, it is only required to adjust the initial brightness value of the first backlight partition according to the initial brightness value of the one second backlight partition, thus simplifying the process of adjusting the initial brightness value of the first backlight partition.

A brightness adjuster 620 in each backlight module may obtain the initial brightness value of the second backlight partition located at edge of the second backlight module as the reference brightness value in any suitable way. Optionally, a display module further comprises a data transmission unit. The data transmission unit is configured to receive, from other display modules, initial brightness values of edge backlight partitions of backlight modules in the other display modules, and transmit initial brightness values of edge backlight partitions of its own backlight module to the other display modules. The brightness adjuster 620 is also used to select the initial brightness value of the second backlight partition located at edge of the second backlight module from the received initial brightness values of edge backlight partitions of other backlight modules than the first backlight module.

The data transmission unit may be of any suitable type. The data transmission unit may, for example, employ a wired transmission type, such as a data line, or a wireless transmission type, such as Bluetooth.

Figure 7:
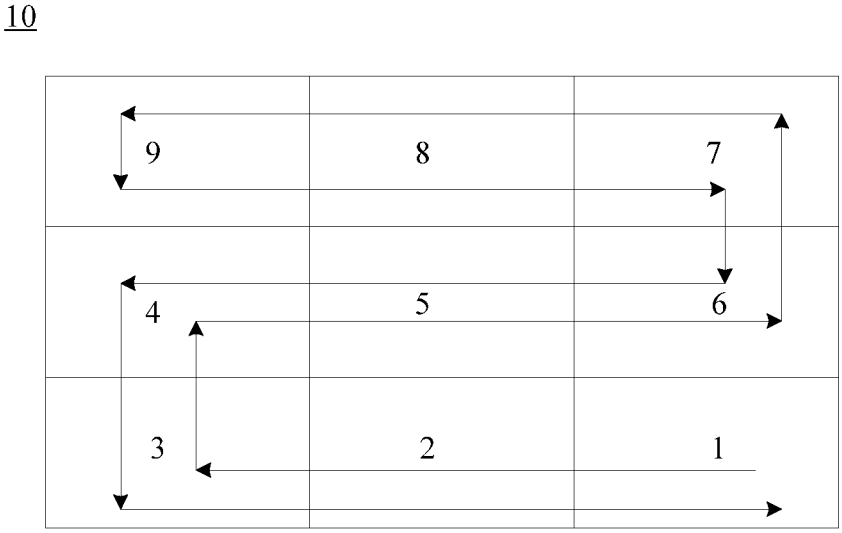
FIG. 7 is a structural schematic view of display modules sequentially cascaded in a display device provided according to an exemplary embodiment.

In some exemplary embodiments, when display modules in a spliced display device 10 are connected through connecting lines via interfaces, such as an Ethernet interface, a serial port or a DVI/HDMI, since each of the display modules comprises a data transmission unit, the data transmission unit of a display module may receive initial brightness values of edge backlight partitions of other backlight modules. In addition, there is no limitation on how to connect the display modules in a spliced display device, as long as a data transmission unit of a display module may receive initial brightness values of edge backlight partitions of other backlight modules. Exemplarily, as shown in FIG. 7, display modules 1-9 may be cascaded in order through a data line via an interface such as a network cable, a serial port or a DVI/HDMI (the arrows in FIG. 7 indicate the direction of data transmission. As shown in FIG. 7, data transmission may be bidirectional. Display module 1 points to display module 2, that is, the data transmission unit in display module 2 may receive the data about the initial brightness values of the backlight partitions in display module 1) by analogy, so as to realize the cascade data sharing among the display modules. Therefore, any display module may receive initial brightness values of edge backlight partitions of other backlight modules through the data transmission unit.

It will be understood that since brightness difference between adjacent display modules is mainly embodied as brightness difference between adjacent edge backlight partitions of adjacent backlight modules, a brightness adjuster 620 of a backlight module 20 is only required to select an initial brightness value of a backlight partition (i.e. the second backlight partition) adjacent to the first backlight partition of the backlight module. The initial brightness value of the selected backlight partition adjacent to the first backlight partition of the backlight module may be referred to as associated data. The initial brightness value of the first backlight partition located at edge of the backlight module may be adjusted according to the associated data.

Exemplarily, returning to FIG. 4, when backlight module 20*a* is the first backlight module, the data transmission unit may first receive initial brightness values of edge backlight partitions of backlight module 20*b*, backlight module 20*c* and backlight module 20*d*, that is, receive initial brightness values of backlight partitions n-1~n-12, backlight partitions o-1~o-12 and backlight partitions p-1~p-12. The brightness adjuster 620 of backlight module 20*a* then selects and saves initial brightness values of backlight partitions adjacent to backlight module 20*a* from the initial brightness values of these backlight partitions, that is, selecting initial brightness values of backlight partitions n-4~n-7 and backlight partitions o-1~o-4. For example, when the first backlight partition is m-1, the initial brightness value of a second backlight partition n-4 is selected, when the first backlight partition is m-12, the initial brightness value of a second backlight partition n-5 is selected, and so on. For the same reasons, when backlight module 20*b* is the first backlight module, backlight module 20*c* is the first backlight module or backlight module 20*d* is the first backlight module, corresponding second backlight partitions may be selected in the same way.

In exemplary embodiments, since an individual display module may receive initial brightness values of edge backlight partitions of other backlight modules 20 through a data transmission unit, when a backlight module 20 is selected to be the first backlight module, a brightness adjuster 620 of that backlight module 20 may select an initial brightness value of a second backlight partition located at edge of a second backlight module from the received initial brightness values of the edge backlight partitions of other backlight modules than the first backlight module.

Various operations of the embodiments are provided herein. In one exemplary embodiment, one or more of the described operations may constitute a computer program or computer-readable instruction stored on one or more computer-readable storage media, and the computer program or computer-readable instruction when executed by the processor or computing device will cause the processor or computing device to perform the described operations. The order in which some or all operations are described should not be construed to imply that these operations are surely order-dependent. Those skilled in the art who benefit from the present disclosure will be aware of an alternative sequence. In addition, it will be understood that not all operations necessarily exist in each embodiment provided herein.

The above are only specific exemplary embodiments, but the scope of protection of the present disclosure is not limited thereto. Variations or replacements that can be easily envisaged by any person skilled in the art within the technical scope of the present disclosure shall fall within the scope of protection of the present disclosure. Therefore, the scope of protection of the present disclosure shall be defined by the scope of protection of the claims.

The invention claimed is:

1. A backlight control method for a spliced display device comprising a plurality of display modules, the display modules including respective backlight modules, each backlight module comprising a plurality of backlight partitions, including a first backlight partition located at edge of a corresponding backlight module of the backlight modules, the method comprising:

for a first backlight partition of a backlight module:

obtaining an initial brightness value and a reference brightness value for the first backlight partition, wherein the reference brightness value is a preset brightness value or an initial brightness value of a backlight partition other than the first backlight partition;

adjusting the initial brightness value of the first backlight partition according to the reference brightness value to obtain an adjusted brightness value for the first backlight partition; and controlling brightness of the first backlight partition according to the adjusted brightness value;

wherein adjusting the initial brightness value of the first backlight partition comprises:

calculating the adjusted brightness value of the first backlight partition according to a formula: $a_1=a_0*[1-(a_0-b_0)/(a_0+b_0)]$, wherein $a_1$ is the adjusted brightness value of the first backlight partition, $a_0$ is the initial brightness value of the first backlight partition and $b_0$ is the reference brightness value.

2. The method according to claim 1, wherein the plurality of display modules include a first display module and a second display module, the first display module comprises a first backlight module, and the second display module comprises a second backlight module, and the second backlight module comprises a second backlight partition located at edge of the second backlight module and adjacent to the first backlight partition located at edge of the first backlight module, and wherein obtaining the reference brightness value for the first backlight partition located at edge of the first backlight module comprises:

obtaining an initial brightness value of the second backlight partition as the reference brightness value for the first backlight partition located at edge of the first backlight module.

3. The method according to claim 2, wherein obtaining the initial brightness value of the second backlight partition comprises:

receiving initial brightness values of edge backlight partitions of other backlight modules than the first backlight module of the plurality of display modules; and selecting the initial brightness value of the second backlight partition from the received initial brightness values.

4. The method according to claim 3, wherein selecting the initial brightness value of the second backlight partition comprises:

selecting the initial brightness value of a backlight partition(s) that is located at edge of the second backlight module and adjacent to the first backlight module along at least one direction.

5. The method according to claim 4, wherein the at least one direction comprises at least one selected from a group consisting of a horizontal direction and a vertical direction.

6. The method according to claim 1, wherein obtaining the initial brightness value for the first backlight partition comprises:

obtaining the initial brightness value for the first backlight partition according to a dynamic local dimming algorithm for the corresponding backlight module.

7. The method according to claim 1, wherein obtaining the initial brightness value for the first backlight partition comprises:

obtaining the initial brightness value for the first backlight partition according to pixel grey scale statistical brightness of a display partition that corresponds to the first backlight partition.

8. A non-transitory computer-readable storage medium storing a computer program, which, when executed by a processor, implements the steps of the method according to claim 1.

9. A computer apparatus comprising a memory, a processor and a computer program stored in the memory and runnable on the processor, which, when executed on the processor, causes the procession to implement the steps of the method according to claim 1.

10. A spliced display device comprising a plurality of display modules, the display modules including respective backlight modules, each backlight module comprising a plurality of backlight partitions that include a first backlight partition located at edge of a corresponding backlight module of the backlight modules, wherein a backlight module comprises:

a light source configured to emit light to output a backlight;

a brightness adjuster configured to obtain an initial brightness value and a reference brightness value for the first backlight partition, wherein the reference brightness value is a preset brightness value or an initial brightness value of a backlight partition other than the first backlight partition, and adjust the initial brightness value of the first backlight partition according to the reference brightness value to obtain an adjusted brightness value for the first backlight partition; and a controller configured to drive the light source to emit light according to the adjusted brightness value so as to control brightness of the first backlight partition;

wherein the brightness adjuster is configured to calculate the adjusted brightness value according to a formula: $a_1=a_0*[1-(a_0-b_0)/(a_0+b_0)]$; and wherein $a_1$ is the adjusted brightness value of the first backlight partition, $a_0$ is the initial brightness value of the first backlight partition and $b_0$ is the reference brightness value.

11. The spliced display device according to claim 10, wherein the plurality of display modules include a first display module and a second display module, the first display module includes a first backlight module, the second display module includes a second backlight module, and the second backlight module comprises a second backlight partition located at edge of the second backlight module and adjacent to the first backlight partition located at edge of the first backlight module, and wherein the brightness adjuster of the first backlight module is configured to obtain the initial brightness value of the second backlight partition as the reference brightness value for the first backlight partition located at edge of the first backlight module.

12. The spliced display device according to claim 11, wherein the plurality of display modules are arranged in a matrix, and the first backlight module is adjacent to at least one second backlight module along at least one direction.

13. The spliced display device according to claim 11, wherein the first display module further comprises a data transmission unit configured to transmit the initial brightness value of the first backlight partition of the first backlight module to one or more other backlight modules in the display device, and receive the initial brightness value of the second backlight partition from the second backlight module.

14. The spliced display device according to claim 10, wherein each of the display modules further comprises a plurality of display partitions, each of which corresponds to a respective backlight partition of the plurality of backlight partitions in the backlight module.

15. The spliced display device according to claim 10, wherein the brightness adjuster is configured to obtain the initial brightness value for the first backlight partition according to a dynamic local dimming algorithm of the corresponding backlight module.

16. The spliced display device according to claim 10, wherein the brightness adjuster is configured to obtain the initial brightness value for the first backlight partition according to pixel grey scale statistical brightness of a display partition corresponding to the first backlight partition.

* * * * *